United States Patent [19]

Kubik

[11] 4,351,131

[45] Sep. 28, 1982

[54] SLIDING WINDOW OR SLIDING DOOR

[76] Inventor: Hans Kubik, Blumenstrasse 5, D-8465 Bodenwohr, Fed. Rep. of Germany

[21] Appl. No.: 144,587

[22] Filed: Apr. 28, 1980

[30] Foreign Application Priority Data

Mar. 27, 1980 [DE] Fed. Rep. of Germany ..... 3011946

[51] Int. Cl.[3] ..... E06B 3/00

[52] U.S. Cl. ..... 49/501; 49/504; 49/425

[58] Field of Search ..... 49/501, 504, 425

[56] References Cited

U.S. PATENT DOCUMENTS 3,703,063 11/1972 Budich et al. ..... 49/504 X

FOREIGN PATENT DOCUMENTS 960514 1/1975 Canada ..... 49/501
2517009 11/1975 Fed. Rep. of Germany ..... 49/425
2528264 1/1977 Fed. Rep. of Germany ..... 49/501
1213971 11/1970 United Kingdom ..... 49/501

*Primary Examiner*—Kenneth Downey
*Attorney, Agent, or Firm*—Silverman, Cass & Singer, Ltd.

[57] ABSTRACT

A glazed assembly is formed of a frame assembly and a sash assembly that is slideable in the frame assembly. The frame assembly is formed of at least four frame parts that have identical cross-sectional shapes. The sash assembly is formed of at least four sash parts that have identical cross-sectional shapes, and a glazing. The frame parts present engaging elements and guide grooves on the two sides thereof facing and opposite the sash assembly so that multiple glazed assemblies can be formed arranged in building block fashion both vertically and laterally of the one frame assembly. The sash parts also present engaging elements and guide grooves; all of said engaging elements have the same cross-sectional shape as a "T", while all of the guide grooves have identical cross-sectional shapes; and the guide grooves and engaging elements are intermating so that a glazed assembly may be formed of the fewest number of differently shaped parts.

17 Claims, 18 Drawing Figures

SLIDING WINDOW OR SLIDING DOOR

The invention relates to a sliding window or sliding door having frame assembly profiles or parts that are rectangular in their cross section, sash assemblies and glazing, where at least one sliding sash placed in the frame, the frame being fastened to a masonry structure, is horizontally or vertically slidable and lockable.

Such sliding windows or sliding doors are known. They have the disadvantage that a multitude of differently formed parts or members must be used in order to make the sliding windows or sliding doors function correctly. Because of the multitude of the parts to be used, the arrangement altogether becomes expensive. Beyond that, it is not possible to arrange individual sliding window elements next to each other or above each other, building block-like, so that the range of applications are considerably restricted because of the unfavorable design of the parts.

Compared to that, the invention provides a sliding window or a sliding door with a simple assembly of the respective parts so that versatile applications are possible and a building block-like construction results.

In the invention, the above-stated problem is solved by the frame having parts that include engaging elements and guide grooves and by the engaging elements of the frame parts and the sash parts being designed identical. Thereby the advantage results that the number of parts to be used can be considerably reduced whereby the production of the frame and sashes is simplified and less expensive; beyond that it is possible to construct the sliding doors or sliding windows building block-like, as required, because of the uniform engaging elements.

In a further development of the invention the engaging elements can be designed as T-crosspieces having a T shaped cross section. According to another characteristic of the invention, the T-crosspieces can be inserted in grooves of guide strip parts, glass strip parts and frame connection parts. According to another characteristic of the invention, an especially advantageous embodiment and simplification results from the fact that the glass strip parts and the guide strip parts are designed to be identical.

In a further development of the invention, the frame parts are designed to have a closed rectangular cross section with at least two chambers and the sash parts, in the cross section can have at least one chamber. Rectangular elongate parts can be inserted advantageously into these chambers as reinforcements so that, if required, additional stiffening of the individual parts results without additional expenditures being necessary.

In a further development of the invention, holding elements of a center closure part can be placed in the guide grooves of the sash parts.

According to another characteristic of the invention, cross-pieces of the frame connection parts can be inserted into the guide grooves of the frame parts. In an advantageous further development, the sash parts can have a recess for either holding a guide, the guide being engaged in a guide groove of the frame part and having a tension spring attached to it, or for carrying bearing wheels so that without any additional constructional costs versatile application possibilities for the recess of the sash part are provided.

According to another characteristic of the invention, the recess can be arranged between two guide grooves of the sash part.

In a further development, the engaging element of the sash part can be arranged on the side of the sash part that is opposite the recess and the two sash grooves as is a hollow crosspice that has a groove for holding a seal. Single or double glazing can be arranged between said hollow crosspiece and a glass strip part carried on the engaging element so that fast and easy assembly results.

According to another characteristic of the invention, guide strip parts and glass strip parts can be provided with a fiber strand seal or rubber seals. Furthermore, rubber seals can be inserted into the guide grooves of the sash part. In an additional development of the invention, the center closure part can have, at a distance from the holding elements thereof, at least one groove for holding rubber seals.

In the following the invention is described in detail by means of embodiments illustrated in the drawing.

Figure 1:
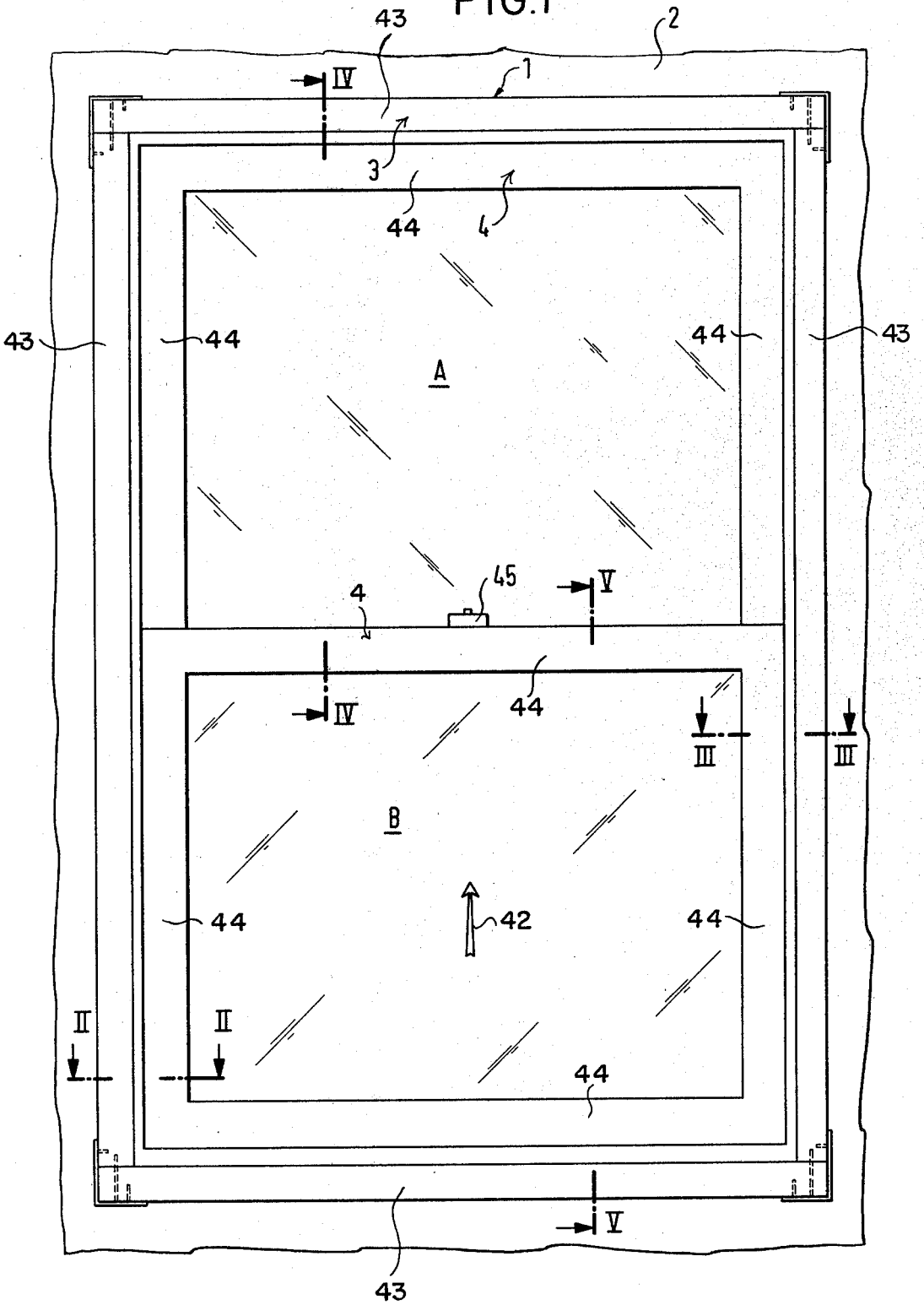
FIG. 1 shows a schematic front view of a vertically sliding window.

The vertically sliding window assembly 1 illustrated in a front view in FIG. 1 consists of a frame assembly 3 as well as two sash assemblies 4. The frame assembly 3 is fastened to masonry 2. The window assembly 1 is made of two parts, an upper sliding sash A and a lower sliding sash B. The two sliding sashes A and B are held in the closing position by way of a locking mechanism 45, which is not shown in detail. If the locking mechanism 45 is released, the lower sliding sash B may be moved upward in the direction of the arrow 42 whereby opening of the sliding window is obtained. If required, it is also possible for instance in order to clean the window panes, to slide the upper sliding sash A downward. The parts used for the sliding window as defined in the invention, i.e., mainly the frame assembly 3 and the sash assemblies 4, are shown in details in FIGS. 10 and 11. Essentially, the frame assembly 3 is formed of four parts 43, having the same cross-sectional shape and the sash assemblies 4 each are formed of four parts 44 of the same cross-sectional shape.

Figure 10:
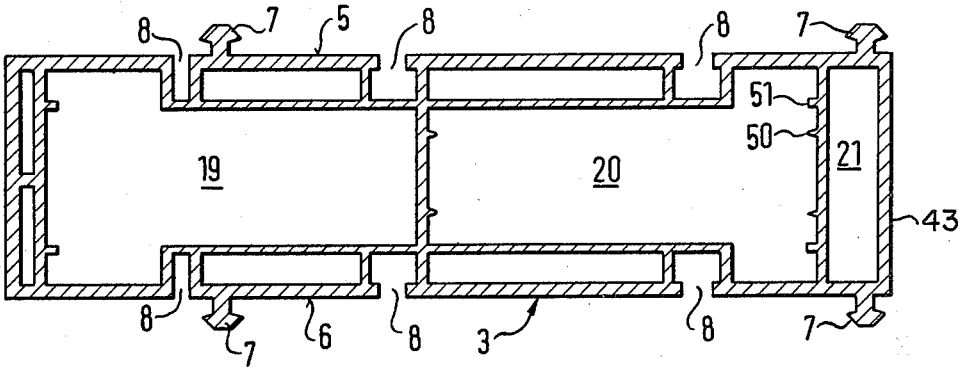
FIGS. 10–18 show different profile shapes in cross section.

In FIG. 10, the frame assembly 3 is formed of a part 43. Part 43 has, on two opposite sides 5 and 6, engaging elements 7 which are designed as T-crosspieces. Here the engaging elements 7 are exactly opposite each other on the sides 5 and 6. Furthermore, guide grooves 8 are provided on sides 5 and 6. The entire part 43 is designed to be rectangular and to provide three chambers 19, 20 and 21.

Figure 11:
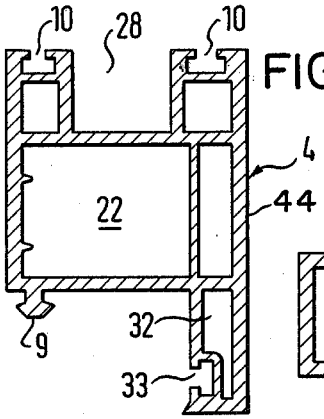

In FIG. 11, the sash assembly 4 is formed of a part 44. Part 44 is provided with an engaging element 9 which is also designed as a T-crosspiece. The engaging element 9 of the sash part 44 has the same shape as the engaging elements 7 of the frame part 43. The part 44 provides a closed chamber 22. On one side of the part 44 there is a recess 38 which is bordered by guide grooves 10. On the opposite side of part 44 there is arranged a hollow crosspiece 32 which is provided with a groove for holding a seal.

Figure 12:
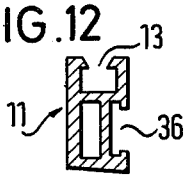
Figure 13:
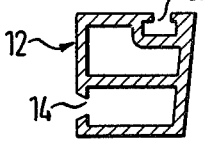
Figure 14:
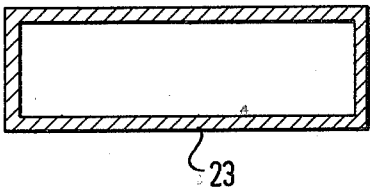
Figure 15:
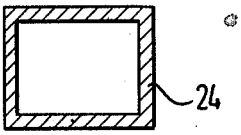

The construction of a sliding window, as defined in the invention here, also requires glass strip parts or guide strip parts 11 or 12, formed as shown in FIGS. 12 and 13, respectively. The glass strip parts and guide strip parts 11 or 12 have grooves 13 and 14, and 36 and 37.

Figure 16:
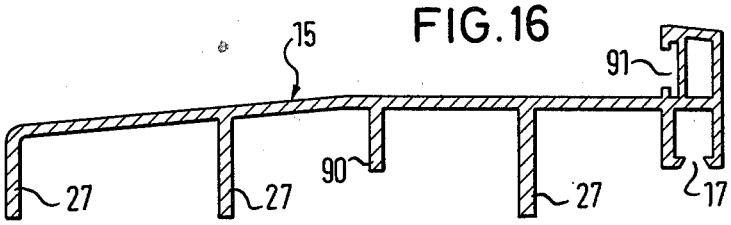
Figure 18:
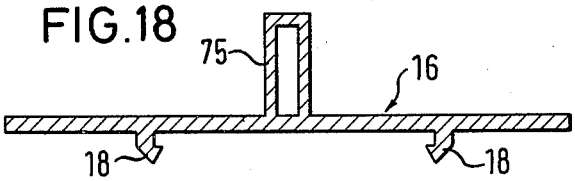

Furthermore, frame connection parts 15 and 16 are required, illustrated in FIGS. 16 and 18. The frame connection part 15 has several crosspieces 27 located at a distance from each other as well as grooves 17 and 91. The frame connection part 16 has two engaging elements 18 located at a distance from each other, and a center crosspiece 75.

Figure 17:
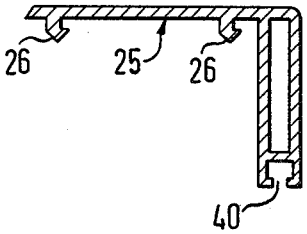

In FIG. 17 there is shown a center closure part 25 which has two engaging elements 26 as well as a groove 40.

Figure 2:
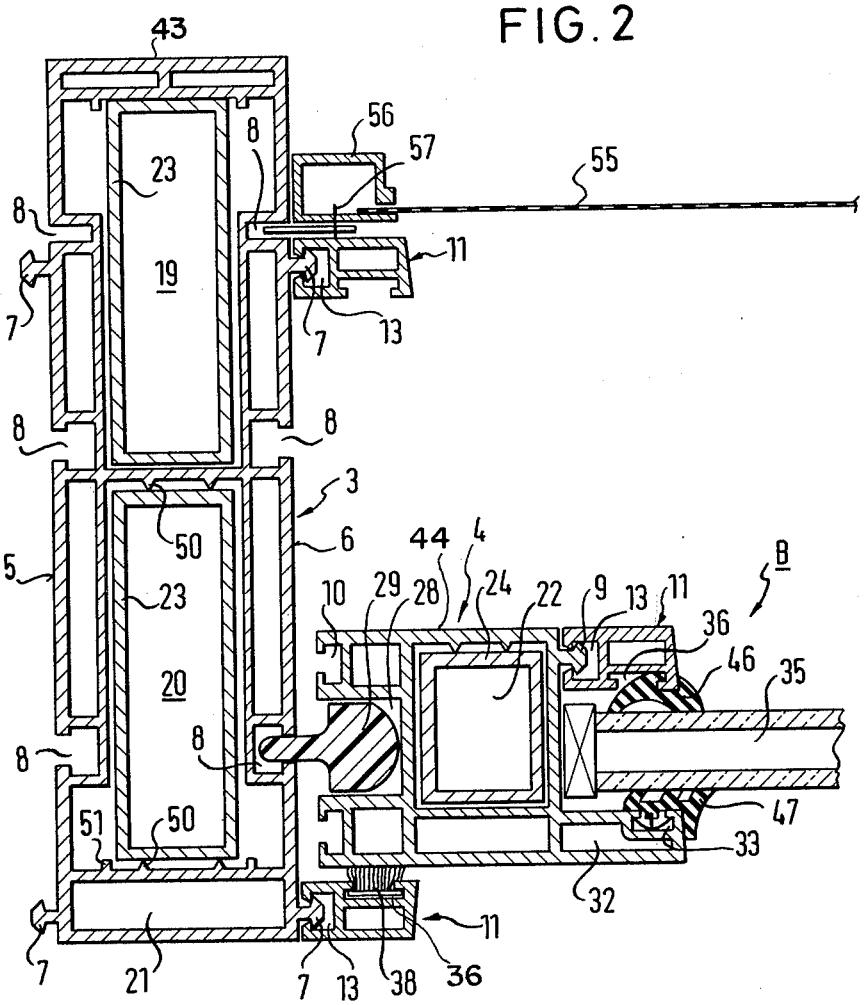
FIG. 2 shows a partial section along line II—II in FIG. 1 in the direction indicated by the arrows.

In FIG. 2 there is shown a section taken along the line II—II of FIG. 1. As it can be seen, the frame part 43 is connected to two guide strip parts 11 by way of the two engaging elements 7 present on side 6-with the engaging elements 7 being inserted in the grooves 13 of the guide strip parts. The lower guide strip part 11 carries a fiber strand seal 38 in the groove 36.

In one guide groove 8 on side 6 of the frame part 43 there is engaged a guide 29 which is carried within a recess 28 of the sash part 44. Within the closed chamber 22 of the sash part 44 there is arranged an elongate, rectangular part 24, as a reinforcement. The guide groove 13 of another glass strip part 11 engages the engaging element 9 of the sash part 44. This glass strip part 11 holds in its groove 36 a rubber seal 46 that works together with a rubber seal 47 to hold a double glass pane 35. The rubber seal or packing 47 is carried in a seal holding groove 33 of the hollow crosspiece 32 of the sash part 44.

Within the frame part 43, elongate, rectangular parts 23 are arranged in chambers 19 and 20 as reinforcements. For the functionally correct positioning of said rectangular parts 23 projections 50 and guides 51 are provided inside the chambers 19 and 20. As it can be seen, the lower sliding sash B, i.e. the sash assembly 4 with the double glazing 35, can be moved vertical relative to the viewing plane—with the terminal zone of the guide 29 sliding within the guide groove 8 of the frame part 43.

At a distance from the sliding sash B, a screen window 55 can be fastened on the frame assembly 3 by way of a frame part 56. A locking device 57, which is not shown in detail, can serve for mounting or removing said screen 55.

As it can be seen, the frame part 43 has engaging elements 7 as well as guide grooves 8 not only on side 6 but also on side 5. Thereby it is readily possible, for instance, to attach a sash part 44 on side 5 by way of guide strip parts 11. If required, an additional sliding sash B can thereby be attached also on side 5.

Figure 3:
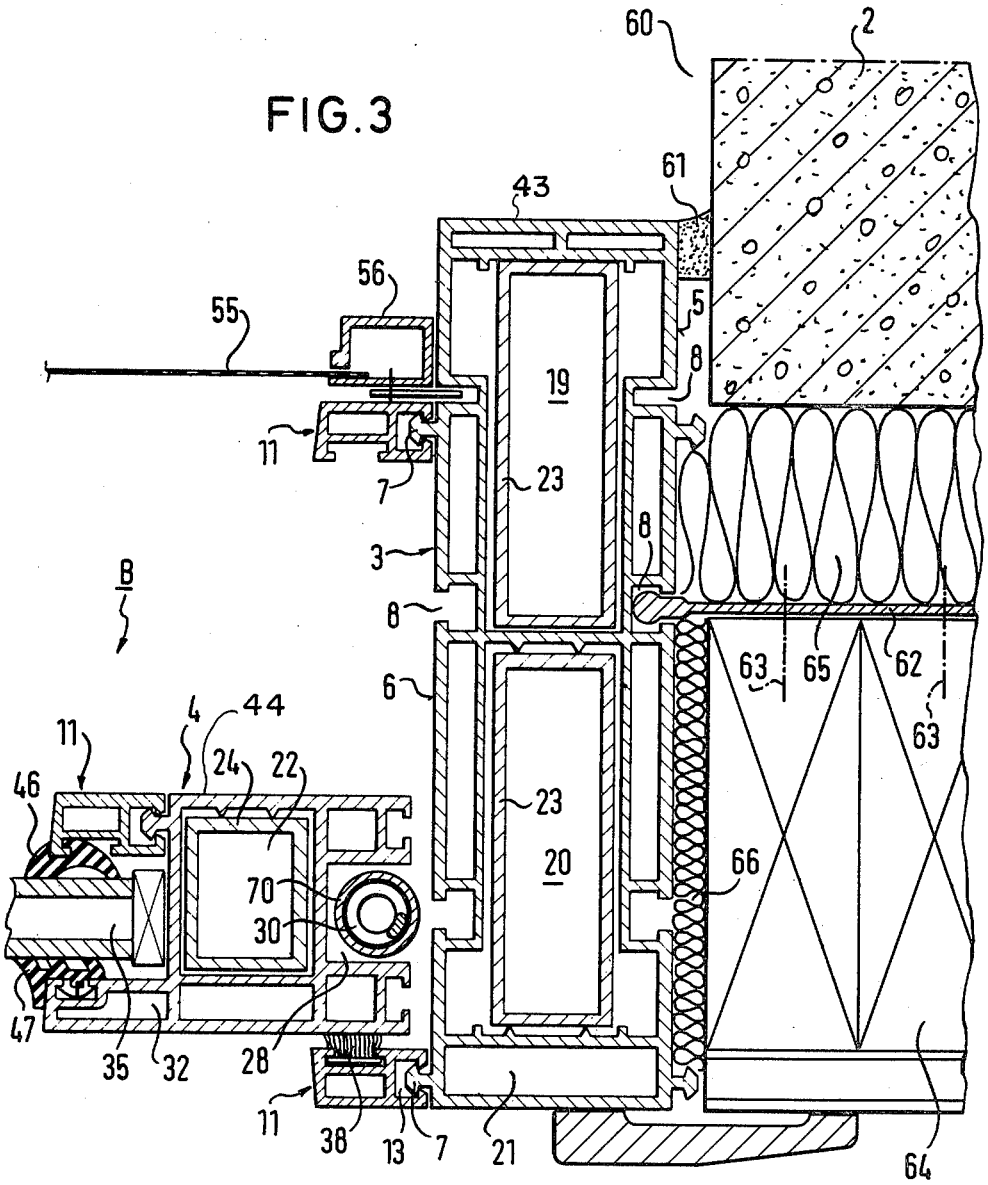
FIG. 3 shows a partial section along line III—III in FIG. 1 in the direction indicated by the arrows.

In FIG. 3, a section through the window assembly 1 along line III—III in FIG. 1 is shown. Again a frame part 43 as shown in section in FIG. 11 is used. Said frame part 43 is fastened on side 5 to a masonry structure 2. A seal 61 is provided for sealing the frame part 43 to the outside 60 of the masonry structure 2. On the inside there is a mounting flange 62 which is fastened on the wood frame 64 by way of nails 63 which are not shown in detail.

The terminal zone of the mounting flange 62 engages in a guide groove 8 of the frame part 43 whereby secure fastening of the frame profile exists. Insulating material 65 is arranged between the masonry structure 2 and the wooden frame 64. Furthermore, insulating material 66 is inserted between the wooden frame and the side 5 of the part 43. Inside the two chambers 19 and 20, rectangular parts 23 are again arranged as reinforcement.

Within the chamber 22, the sash part 44 is also provided with a rectangular part 24 as a reinforcement. The hollow crosspiece 32 of the sash part 44 also has a seal 47 that working together with the seal 46 arranged on the glass strip part 11, carries the double glazing 35. Pressure is exerted on the outside of said part 44 by a strip of fiber strand seal 38 which is attached to the guide strip part 11. As it can be seen, the guide strip part 11 has the same shape as shown in FIG. 12 for holding the glass or for guiding the sash. The guide strip part and glass strip part have therefore the same reference character 11. The guide strip part 11 holding the fiber strand seal 38 is connected with the engaging element 7 of the frame part 43 by way of the groove 13.

A cross section of a spring 30 is shown in the recess 28 of the sash part 44. Said spring is surrounded by a protecting tube 70.

Figure 4:
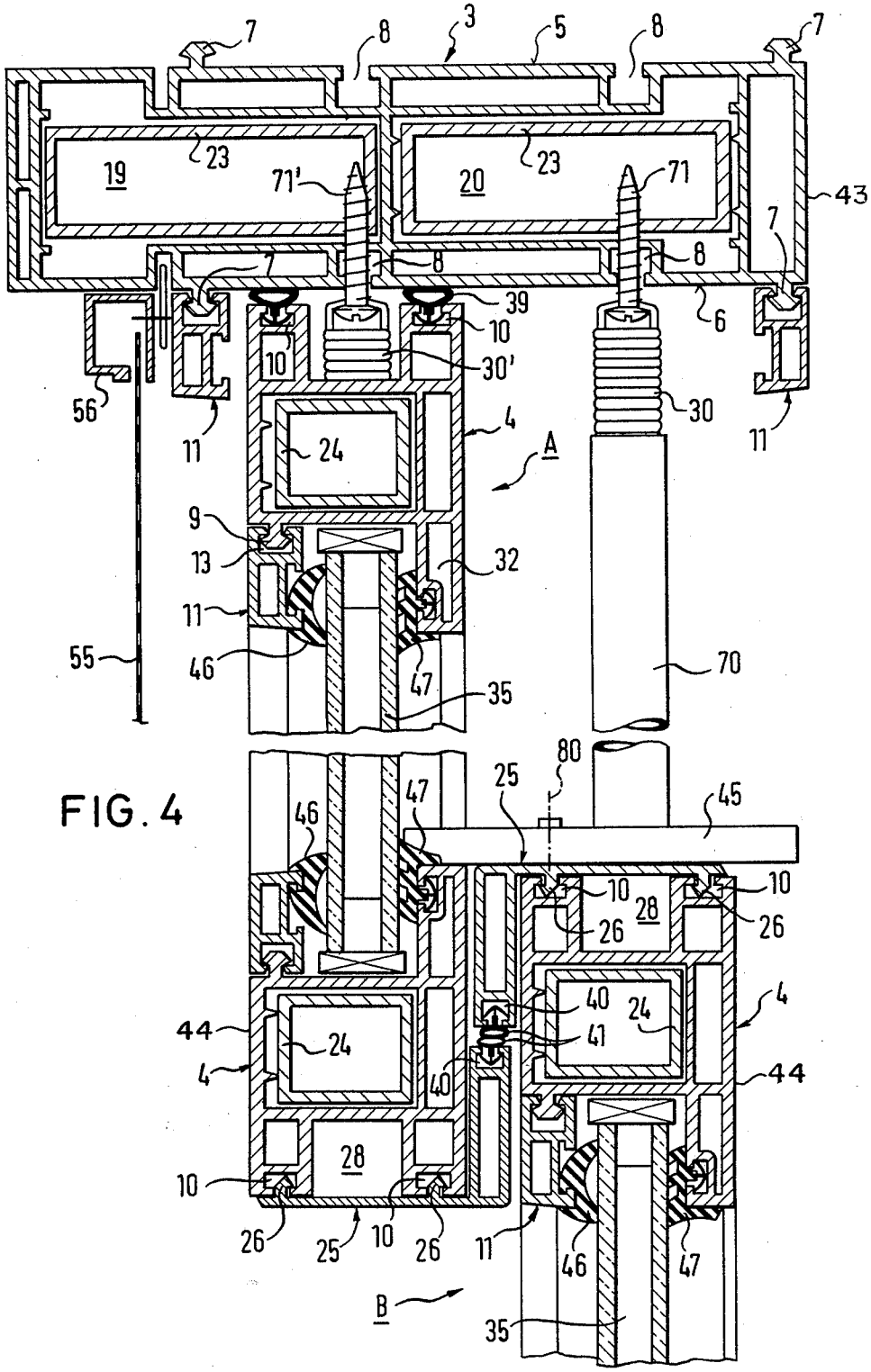
FIG. 4 shows a partial section along line IV—IV in FIG. 1 in the direction indicated by the arrows.

The spring 30 as well as the protecting tube 70 are shown in detail in FIG. 4 which illustrates a section taken along the line IV—IV in FIG. 1. Spring 30 is connected to the rectangular part 23 in the chamber 20 of the frame part 43 by way of a screw coupling 71. In a lower zone, the spring 30 is connected with the guide element 29, shown in FIG. 2, which also is fastened on the sash part 44. Thereby it is possible to slide the lower sliding sash B of the sliding window upward after the unlatching of the locking mechanism 45, whereby releasing of the spring 30 takes place and the opening of the lower sliding sash B of the sliding window is facilitated. The spring shortens—with the terminal zone of the guide 29 sliding in the guide groove 8 of the frame part 43 during the upward motion, according to FIG. 2.

In FIG. 4, the closed sliding window with the upper sliding sash A and the lower sliding sash B is illustrated—with the spring being tensioned. As it can be seen, two engaging elements 7 engage in guide strip parts 11 on the side 6 of the frame part 43. Furthermore, the screen 55 is held by way of the frame part 56 illustrated before in FIGS. 2 and 3. The upper sliding sash A of the sliding window is connected with a spring 30' which is connected in the rectangular part 23 in the chamber 19 by way of a screw coupling 71'. The upper sliding sash A as well as the lower sliding sash B each consist essentially of the sash part 44 as well as the double glazing 35. The sash part 44 holds, in the guide grooves 10 of the upper sliding sash A, rubber seals 39 which bear against the side 6 of the frame part 43 in the closed state and present good thermal insulation. The hollow crosspiece 32 of the sash part 44 hold the rubber seal 47 whereas the glass strip part 11, which is fastened on the engaging element 9 of the sash part 44 by way of groove 13, holds the rubber seal 46.

The lower sash part 44 of the upper sliding sash A as well as the upper sash part 44 of the sliding sash B are each equipped with center closures 25, illustrated in FIG. 17. Said center closure part has two parallel holding elements 26 that are inserted into the guide grooves 10 of the respective sash parts 44. Thus, the recess 28 of each sash part 44 is covered by the center closure 25. The groove 40 of each center closure 25 is provided with a rubber seal 41 so that the two rubber seals 41 bear on each other when sashes A and B are in the closed state and guarantee faultless sealing therebetween.

The opening of the sliding window 1 occurs by turning the locking mechanism 45 around the axis 80 whereby after turning the mechanism 45 by approximately 90° the lower sliding sash B can now slide upward under the effect of the spring 30 so that the lower zone of the sliding window is opened.

Figure 5:
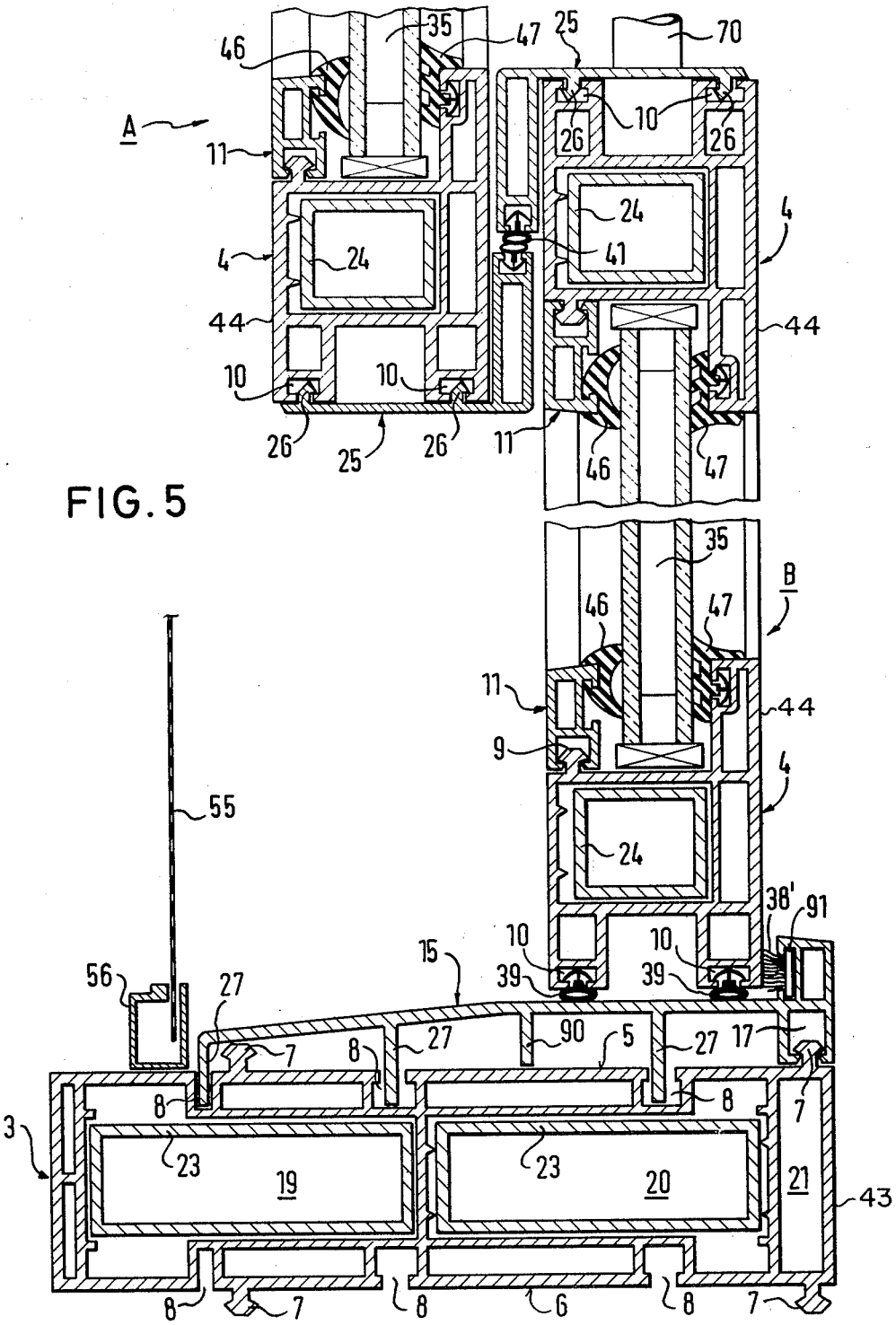
FIG. 5 shows a partial section along line V—V in FIG. 1 in the direction indicated by the arrows.

In FIG. 5, there is illustrated a section taken along the line V—V of FIG. 1. As it can be seen, the sash parts 44 have in the lower zone of the upper sliding sash A and in the upper zone of the sliding sash B the previously mentioned center closures 25 that, by means of their holding elements 26, are engaged in the guide grooves 10 of the respective sash parts.

The lower sash part 44 of the lower sliding sash B is provided with seals 39 which are carried in the guide grooves 10. These seals exert pressure on the upper side of a frame connection part 15 shown in detail in FIG. 16. The frame connection part 15 has several crosspieces 27 spaced from one another that are engaged in the guide grooves 8 of the lower frame part 43. Between the two center crosspieces 27 there is provided a spacing crosspiece 90 that rests on the side 5 of the frame part 43. Furthermore, said frame connection part 15 is provided with a groove 17 which engages an engaging element 7 of the frame part 43 thereby securing fastening of the frame connection part 15 to the lower frame part 43. Beyond that, the frame connection part 15 has on the right side a groove 91 that carries a strip of fiber strand seal 38'. Said fiber strand seal 38' exerts pressure on the sash part 44 on the right side so that when the sliding window is closed a faultless and clean closure exists with the several strips of fiber strand seals and rubber seals.

As it can be seen, it is again possible because of the special design of the frame part 43 to attach additional guide parts on the side 6 of the lower frame part 43 so that the sliding window can be expanded building block-like from the lower zone. If no expansion is desired, the lower frame part 43 can be fastened to the masonry structure in a way analogous to the connection illustrated in FIG. 3. As it can be seen, the lower zone of screen 55 is arranged on the side 5 of the lower frame part 43 by way of a part 56 which is not identified in detail. Rectangular parts 23 for reinforcement again are arranged in the chambers 19 and 20 of the lower frame part 43.

In place of the sliding window illustrated in FIGS. 1 to 5, it is also possible, according to FIGS. 6 to 9, to design a sliding window or a sliding door 59 such that, for instance, a left sliding sash B' is slid horizontally toward the right to cover a right sliding sash A' and opening of the window or the door takes place. According to FIG. 6, by way of the locking mechanism 45' which is not shown in detail, the left sliding sash B; with its sash part 44 is held in the closed position opposite the frame part 43.

Figure 6:
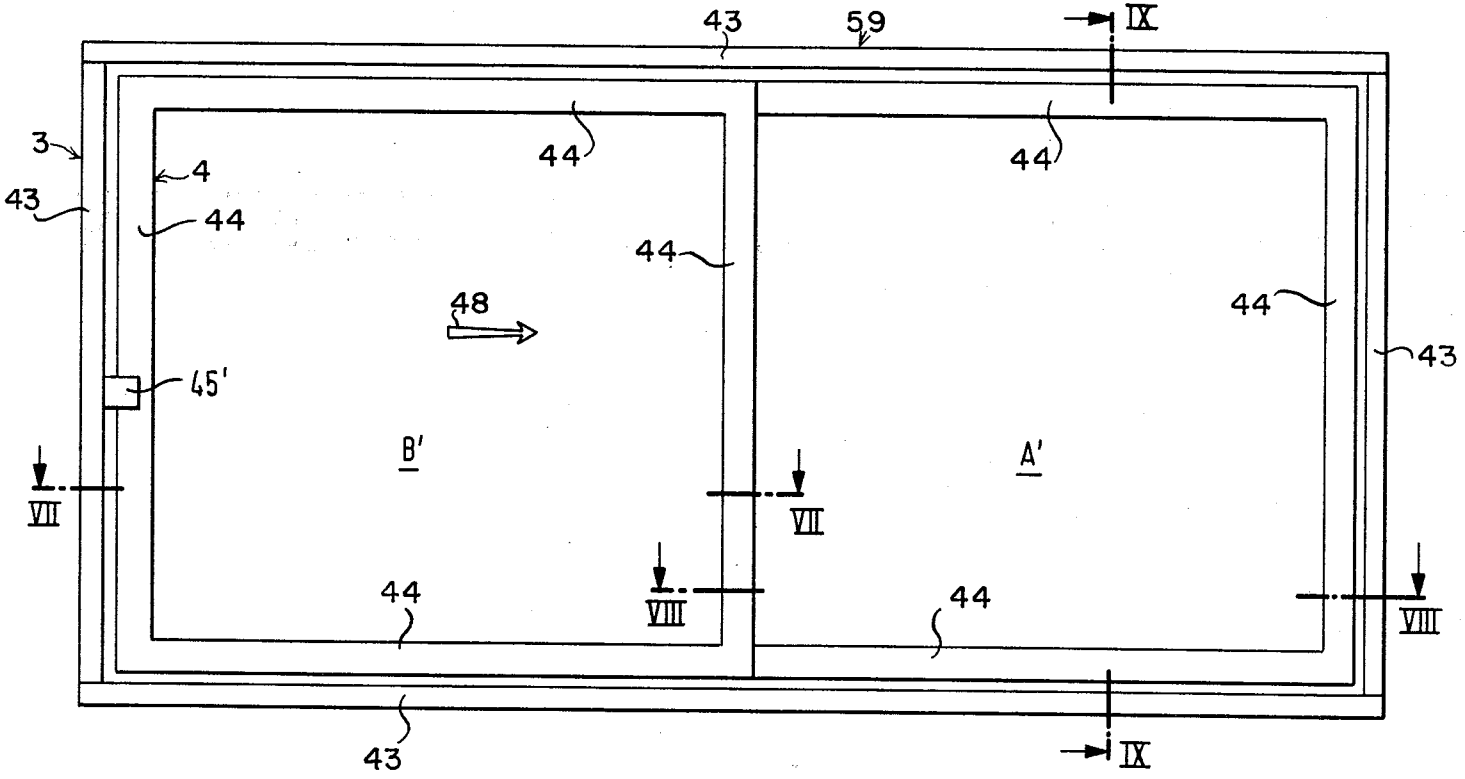
FIG. 6 shows another possibility of a sliding window slidable in the horizontal plane.
Figure 7:
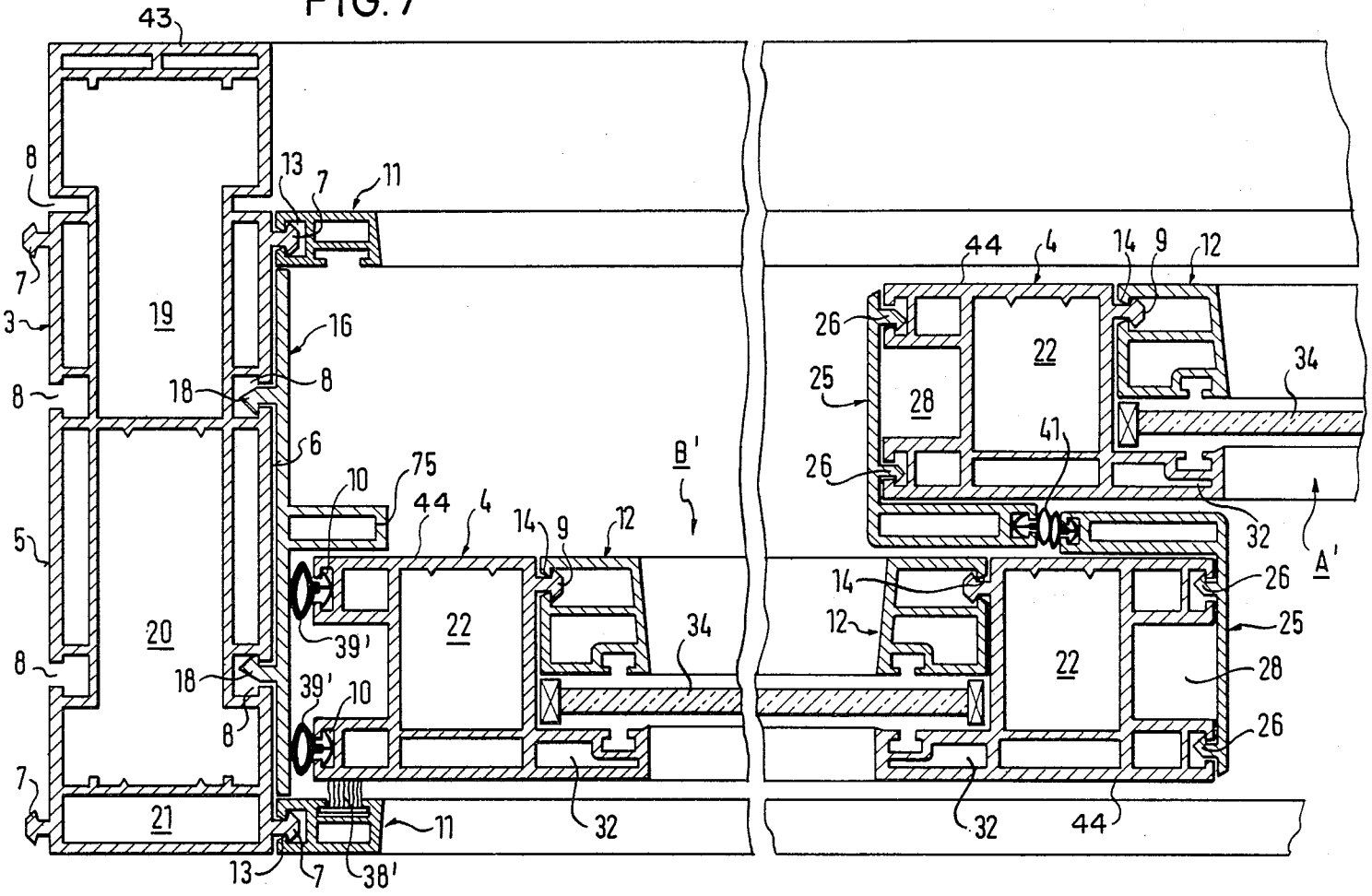
FIG. 7 shows a partial section along line VII—VII in FIG. 6 in the direction indicated by the arrows.

In FIG. 7, a section along the line VII—VII in FIG. 6 is illustrated in detail. There is again used the frame part 43 which on its side 5 can be connected with a masonry structure in a well-known manner. On side 6 there is engaged in the guide grooves 8 engaging elements 18 of a frame connection part 16 that is shown in detail in FIG. 18. Beyond that, there are fastened on the frame part 43 two guide parts 11 which are engaged on engaging elements 7 by means of their grooves 13, namely in the front zone as well as in the back zone of the sliding window. The sliding window 59 consists of, with respect to its left sliding sash B' as well as also to its right sliding sash A', sash parts 44 and, in the present case, of a single glazing 34. If this single glazing is used, the glass strip part 12 of FIG. 13 is used. Here glass strip part 12 is placed, by way of its groove 14, on the engaging element 9 of the sash part 44. On the opposite side, the single glass pane is held by the hollow crosspiece 32 of the sash part 44.

The sash part 44 of the left sliding sash B' has on the left side rubber seals 39' which are engaged in the guide grooves 10 of the sash part 44. In this embodiment, neither the frame part 43 nor the sash part 44 are provided with reinforcements in their chambers 19, 20 and 22.

In the center zone, each of the two sash parts 44 again are provided with a center closure 25 whereby the recesses 28 of the sash parts 44 are closed. Both center closures 25 again have rubber seals 41 which bring about the sealing of the two sliding window sashes B' and A'. Another good seal exists at the fiber strand seal 38' that is arranged on the inside of the guide strip 11 in the zone of the frame part 43.

Figure 8:
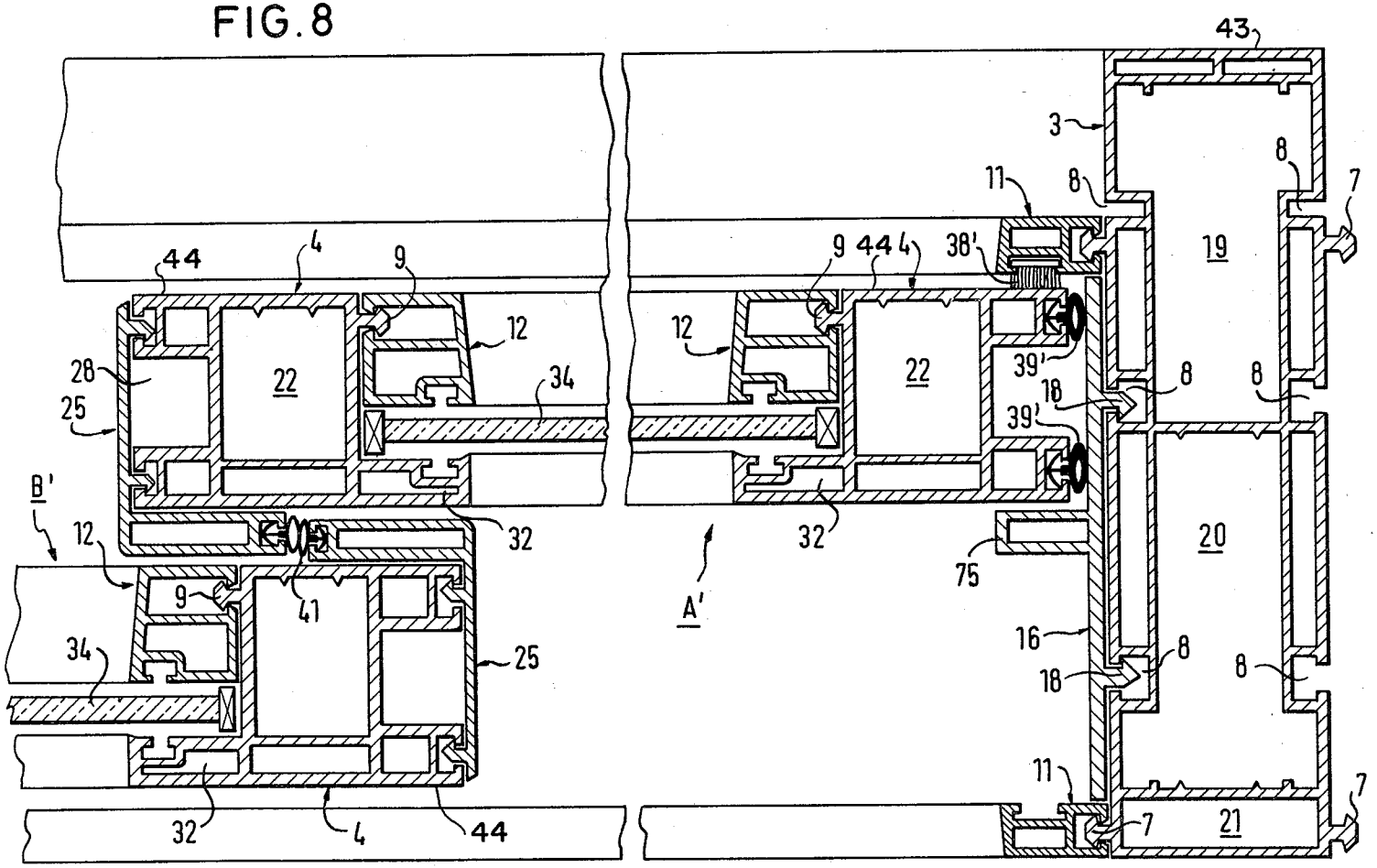
FIG. 8 shows a partial section along line VIII—VIII in FIG. 6 in the direction indicated by the arrows.
Figure 9:
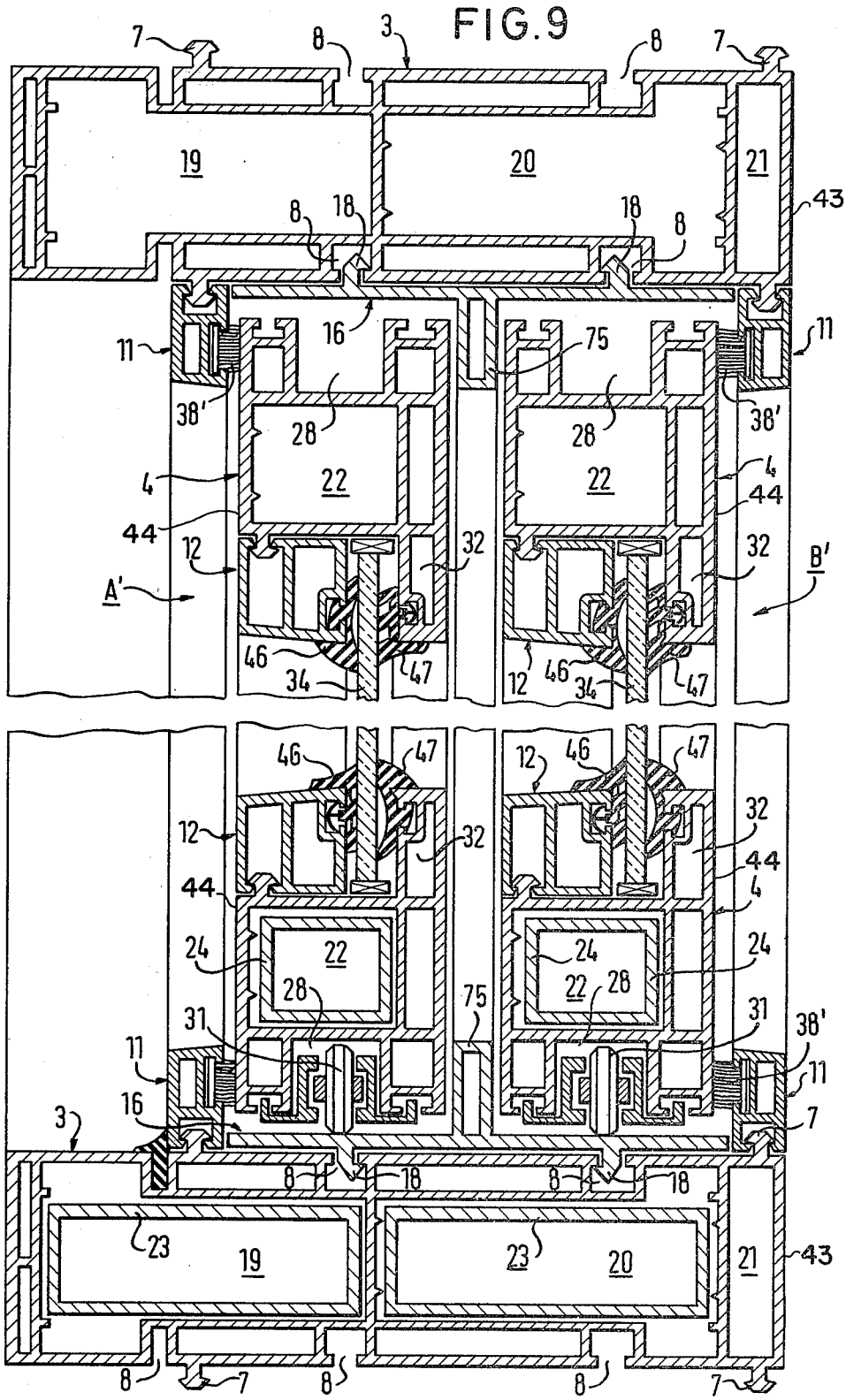
FIG. 9 shows a partial section along line IX—IX according to FIG. 6 in the direction indicated by the arrows.

In FIG. 8 there is shown a section taken along the line VIII—VIII in FIG. 6. Again a frame part 43 is used which is fastened on the masonry structure in a well-known manner. Again there are provided sash parts 44 as well as center closures 25 in the center zone. The frame part 43 is equipped with a frame connection part 16 and against which the rubber seals 39' of the right sash part 44 of the right sliding sash A' bear when the entire sliding window is in the closed state.

Since a single glazing is used, a glass strip part 12 is again used here and is connected to the sash part 44 by way of engaging elements 9. In order to guarantee a good seal, the outside guide strip part 11 is provided with a fiber strand seal 38' that bears on the outside of the corresponding sash part of the right sliding sash A'.

If the closure 45' illustrated in FIG. 6 is unlocked, the left sliding sash B' can be moved to the right in the direction of the arrow 48 whereby opening of the sliding window takes place. In order to be able to carry out this opening operation easily, the lower sash part 44 should be equipped with rollers 31 that can roll on the upper side of the frame connection part 16. By way of its engaging elements 18, this frame connection part 16 again engages in the corresponding guide grooves 8 of the lower frame part 43. Furthermore, the lower frame part 43 is equipped with rectangular profiles 28 within the chamber 19 and 20. On the outside and on the inside engaging elements 7 of the upper and the lower frame parts 43, there are provided guide strip parts 11 that are equipped with fiber strand seals 38'. These fiber strand seals 38' exert pressure on the sash parts 44 of the left and of the right sliding sashes A' and B'.

Since single glazing is used, there is again used a glass strip part 12 to exert pressure on the glazing by way of seals 46. The respective hollow crosspieces 32 of the sash parts 44 are equipped with seals 47. The center crosspiece 75 of the frame connection profile 16 guarantees that exact guiding takes place during the sliding of the left sliding sash B′ or the right sliding sash A′.

Because the lateral sliding possibility of the two sliding sashes exerts pressure on the lower zone of the sash parts 44, it is expedient to equip the lower sash parts 44 with rectangular profiles 24.

Thus there results that, independent of the sliding motion of the sliding parts, only very few building elements are required for the assembly of the sliding window as defined in the invention in order to create an optimum of possibilities of motion. The frame part 43 is designed here in such a way that on the lower side as well as on the upper side and also in the horizontal plane there exist further possibilities of attaching sliding parts by way of the respective sash parts 43. Thereby a further area of application has been created with a simple assembly for the sliding window or the sliding door as defined in the invention.

I claim:

1. A glazed assembly comprising:

a frame assembly formed of at least four frame parts having identical and substantially rectangular cross-sectional shapes and the frame assembly being fastened to a structure; and at least one sash assembly that is formed of at least four sash parts having identical cross-sectional shapes and a glazing, the sash assembly being mounted in said frame assembly and being slidable and lockable therein;

each of said frame parts having a pair of sides opposite one another with one side facing the sash assembly and the other side facing the structure, the pair of sides presenting engaging elements and guide grooves;

each of said sash parts presenting engaging elements and guide grooves; and the engaging elements of the frame and sash parts having identical cross-sectional shapes and the guide grooves of the frame and sash parts having identical cross-sectional shapes and the engaging elements and guide grooves having intermating cross-sectional shapes.

2. The assembly as claimed in claim 1 in which the cross-sectional shape of the engaging elements is "T" shaped.

3. The assembly as claimed in claim 1 in which said frame assembly and sash assembly further include guide strip parts, glass strip parts and frame connection parts that have guide grooves of the same cross-sectional shape as the guide grooves of the frame and sash parts, and the engaging elements of the frame and sash parts are insertable in the guide grooves of the guide strip parts, the glass strip parts and the frame connection parts.

4. The assembly as claimed in claim 3 in which said glass strip parts and said guide strip parts have the same cross-sectional shape.

5. The assembly as claimed in claim 3 in which said frame connection part includes crosspieces that are insertable in the guide grooves of the frame parts.

6. The assembly as claimed in claim 1 in which the frame parts have a cross-sectional shape in the form of a closed rectangle with at least two chambers therein and the sash parts have in cross-section at least one closed chamber.

7. The assembly as claimed in claim 6 further including elongate rectangular parts arranged in the chambers as reinforcements.

8. The assembly as claimed in claim 1 in which said sash assembly further includes a center closure part that has holding elements which are insertable in the guide grooves of the sash parts.

9. The assembly as claimed in claim 8 in which each of the sash parts present a recess between two guide grooves and the center closure part covers said recess and the holding elements thereof are insertable in said two guide grooves.

10. The assembly as claimed in claim 1 in which each of the sash parts present a recess, and further including a guide which is engageable in said recess and one of the guide grooves of the frame parts to guide said sash part along said guide groove during rectilinear movement of said sash part.

11. The assembly as claimed in claim 10 in which each of the sash parts present a recess, and further including a tension spring fastened to the guide in the recess.

12. The assembly as claimed in claim 1 in which each of the sash parts present a recess, and further including bearing wheels engagable in said recess.

13. The assembly as claimed in claim 1 in which each of said sash parts presents a recess between two guide grooves, said recess between two guide grooves being on one side of said sash part and on an opposite side, said sash part presents an engagement element, a hollow crosspiece, said hollow crosspiece presenting a guide groove for carrying a seal.

14. The assembly as claimed in claim 13 further including a glass strip part that has guide grooves of the same cross-sectional shape as the guide grooves of the frame and sash parts and the glass strip part is engaged on the engagement element on the opposite side of the sash part and said glazing is engaged between said glass strip part and said hollow crosspiece.

15. The assembly as claimed in claim 14 in which the glass strip part is provided with a seal groove carrying a seal.

16. The assembly as claimed in claim 1 in which the guide grooves of the sash parts carry rubber seals.

17. The assembly as claimed in claim 8 in which the center closure part presents at least one groove that carries a seal.

* * * * *